United States Patent [19]

Lu

[11] 4,097,620

[45] Jun. 27, 1978

[54] MAGNETIC TONER PARTICLE COATING PROCESS

[75] Inventor: Chin H. Lu, Webster, N.Y.

[73] Assignee: Xerox Corporation, Stamford, Conn.

[21] Appl. No.: 792,634

[22] Filed: May 2, 1977

[51] Int. Cl.[2] ..... G03G 9/08; H01F 1/11

[52] U.S. Cl. ..... 427/127; 427/220; 427/384

[58] Field of Search ..... 427/127, 215, 120, 221, 427/384; 252/62.1 P

[56] References Cited

U.S. PATENT DOCUMENTS

| | | | |
|---|---|---|---|
| 3,790,407 | 2/1974 | Merten et al. | 117/240 |
| 3,922,381 | 11/1975 | Datta | 427/21 |
| 3,928,220 | 12/1975 | Slusarczyk | 252/62.62 X |
| 3,973,948 | 8/1976 | Laferty et al. | 427/215 X |

OTHER PUBLICATIONS

"Chemistry of Organic Compounds," Noller, pp. 151 and 156.

*Primary Examiner*—Bernard D. Pianalto

[57] ABSTRACT

A method of coating magnetic toner particles such as magnetite with a fatty acid or a derivative of a fatty acid is disclosed. The magnetite particles coated by this process are found to be particularly suitable for use in formation of field dependent toners that are not humidity sensitive.

18 Claims, 1 Drawing Figure

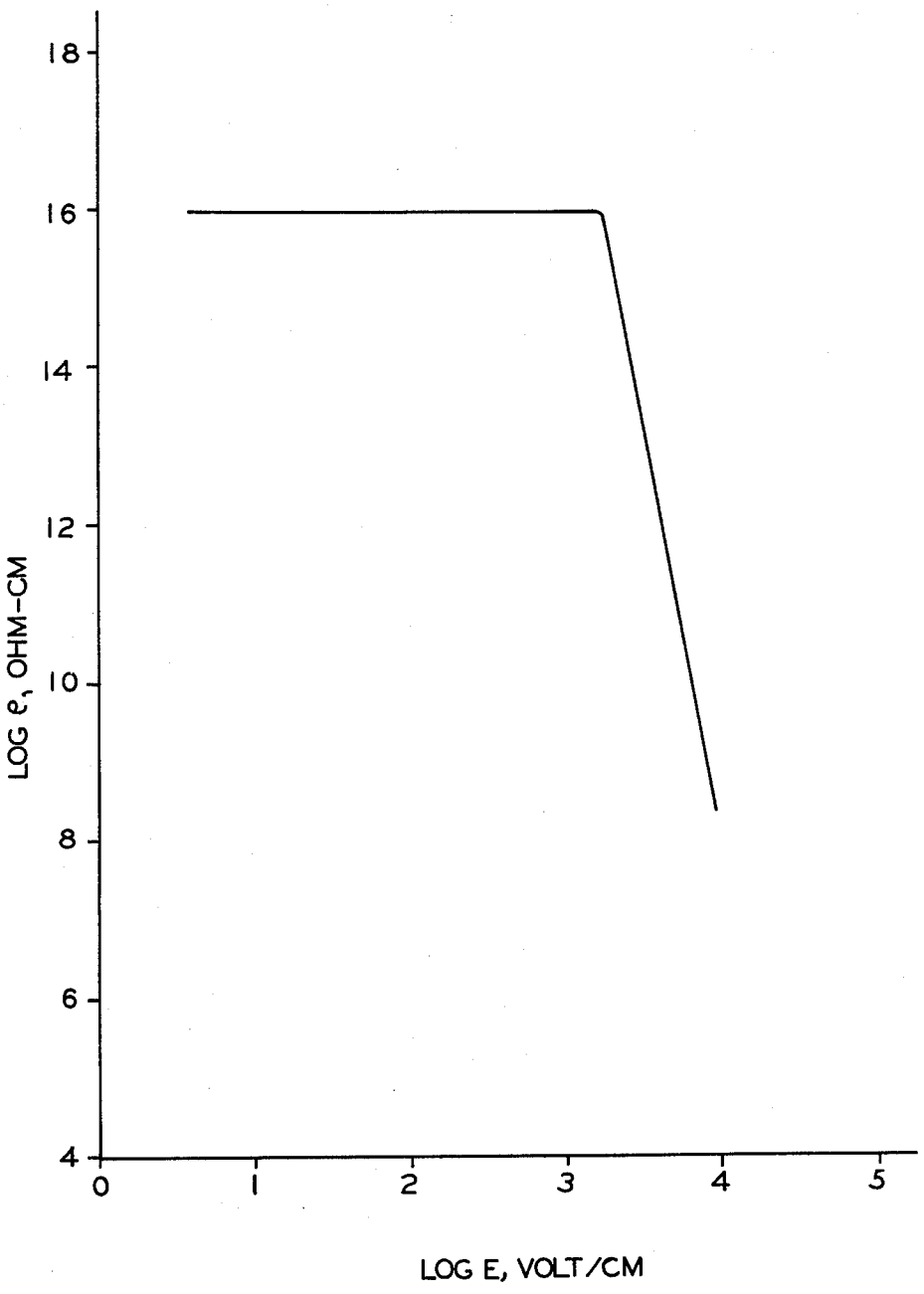
18
16
14
12
10
8
6
4
LOG ρ, OHM-CM
0
1
2
3
4
5
LOG E, VOLT/CM

MAGNETIC TONER PARTICLE COATING PROCESS

BACKGROUND OF THE INVENTION

This invention relates to electrophotographic development utilizing magnetic toner particles which are applied from magnetic brush to the electrostatic latent image without use of a carrier material.

A vast majority of the electrographic copying processes in use today involve creation on a suitable recording medium of an electrostatic charge pattern corresponding to a pattern of light and shadow to be reproduced and the development of that pattern by deposition of marking material on the recording medium according to forces generated by such electrical potential pattern. Xerography is the most widely known of these techniques. The substrate may be photoconductive, such as in the case of selenium as taught in Carlson's U.S. Pat. No. 2,297,691, or may be a conventional insulating substrate overlying a photoconductor layer, as described in Watanabe, U.S. Pat. No. 3,536,483, to name a few examples.

After creation the electrical potential pattern is generally developed by means of a finely divided developer powder thus giving form to the hitherto latent electrostatic image. In a common technique a fine, insulating, electroscopic powder is cascaded over the electrical potential pattern bearing member. The powder is, in the conventional use, triboelectrically charged to a definite polarity and deposits preferentially in regions of the surface where there is a preponderance of charge of the opposite polarity. The triboelectric charge is caused by presence of carrier beads in the powder mix. This technique of development is called cascade development.

In another form of cascade development, called magnetic brush development, magnetic carriers or magnetic toners are employed. In this technique a magnetic force is used to provide adherence of the toner-carrier mixture to a support member which is then presented to the image bearing member. In comparison to cascade development, magnetic brush development fills in solid areas better, is more compact, and does not depend on gravity to present the toner to the surface, a factor which allows freedom in locating the developer station.

In yet another form of electrostatic charge pattern development, a conductive one-component toner is used by bringing a conductive support member bearing a layer of fine conductive toner powder into contact with the charge pattern bearing member as in U.S. Pat. No. 3,166,432 to Gundlach. In this case the toner is held to the support member by van der Waal's forces and the conductive support member is held at a bias potential during development. This technique fills in solid areas and requires only one component in the developer material.

A further method of developing an electrostatic charge pattern is to employ an electroscopic toner suspended in a liquid. With the proper choice of materials, the toner becomes charged to a definite polarity when dispersed in the liquid. When the electrostatic charge pattern bearing member is brought into contact with the liquid suspension, the toners deposit where there is a preponderance of charge of the opposite polarity as in cascade development.

While all of the above techniques have certain advantages in particular situations, each one suffers from disadvantages which impair their utility in actual machines.

In the conventional cascade development technique the toner-carrier combination has a definite charge polarity and is not reversible without changing the toner or the carrier. Thus, positive and negative developed images cannot easily be made. Also the images are hollow and solid areas are not filled in resulting in low-fidelity development compared to the original charge pattern. The triboelectric properties of the toner, while necessary to development, cause severe problems. Uneven charging of the toners causes backgrounding as do the uneven forces between carrier and toner result in varying threshold levels from toner to toner. Also, since the toner retains its charge for long periods of time, during cascading some toners escape the development region and enter other parts of the apparatus causing mechanical problems. These problems, coupled with the inherent problems of using a two-component system where only one component is depleted, definitely limit the utility of such techniques.

The magnetic brush development, as it also uses carrier, suffers from some of the above mentioned disadvantages although it overcomes others. As mentioned above, this technique is less efficient but helps to fill in solid areas. However, it still requires triboelectric toners, which have the concomitant problems mentioned above. Also, due to the mechanical brushing action and other electrical characteristics, this technique usually results in high background deposition and poor machine latitude.

The process described in Gundlach, U.S. Pat. No. 3,166,432, has many advantages over the above mentioned cascade type techniques. However, it suffers from drawbacks which limit its applicability. The van der Waal's forces, which act to adhere the toner onto the conductive support member, are a counterforce to the image producing electric force generated by the electrostatic charge pattern, and as such must be selectively overcome to have toner deposited. The van der Waal's forces are weak and non-uniform from one toner to the next. Also high contrast is difficult to achieve. The fact that the van der Waal's forces are not under direct control but subject largely to the surface properties of the materials involved makes the system highly susceptible to alteration of development properties upon wearing of the involved surfaces or variations in ambient conditions of temperature and humidity.

In a liquid development technique most of the problems of cascade development are present in addition to other unique to a liquid system. The technique requires triboelectric charging, making image reversal difficult as explained above. Also, as in the case of cascade development, the charge on a given toner is not well controlled, resulting in high background deposition, poor machine latitude, and a characteristic splotchiness in large dark or grey areas. The inherent problems of the handling liquids, usually solvents, in a machine are also present.

There have been suggested systems for magnetic development not utilizing the carrier material. One such system was described in U.S. Pat. No. 2,846,333 to Wilson. Wilson et al disclosed the use of magnetic brush to apply toner particles formed of ferrites and resin material to develop electrostatic latent images. The difficulty with this process was the conductivity of the toner made electrostatic transfer difficult.

A further development of magnetic development without carriers is illustrated by Kotz, U.S. Pat. No. 3,909,258 wherein an electrostatic development process utilizing a magnetic brush without carrier is illustrated. A toner suitable for use in the Kotz process is disclosed in U.S. Pat. No. 3,639,245 to Nelson wherein a dry toner powder having specific electric conductivity is disclosed. The toner of Nelson is formed by blending magnetite with the resin and then after blending pulverizing to a small particle size. The particles are then mixed with conductive carbon black which is imbedded in the surface of the particle and then a small particle size $SiO_2$ agent is mixed into the toner to improve the flowability. The toner of Nelson suffers the disadvantages that it does not transfer well from a photoconductive substrate to plain bond paper.

Therefore there is a continuing need for magnetic toners suitable for use in one component magnetic development systems. There is a need for toners suitable for high speed development that also have good electrostatic transfer characteristics for transfer from a photoconductive surface to plain bond paper. There is further a need for a magnetic pigment coating which aids field dependence without introducing undesirable properties such as humidity sensitivity into the toner. There is further a need for methods of rendering pigments hydrophobic and more easily dispersable in polymers.

There is a need for toners which after they are transferred to paper adhere sufficiently well by electrostatic forces that image disturbances (blur) do not readily occur on handling the unfused toner image prior to fixing.

SUMMARY OF THE INVENTION

It is an object of this invention to provide a coated pigment overcoming the above noted deficiencies.

It is a further object of this invention to provide a process of coated pigment manufacture that overcomes the deficiencies of the above noted processes.

It is another object of this invention to produce clear sharp images by magnetic development using a coated pigment without using a carrier.

It is a further object to produce pigment for a toner that will transfer electrostatically from the photoreceptor to plain bond paper.

It is another additional object to form a coated pigment that is hydrophobic.

It is a still further object to produce a coated pigment for toner whose electrical resistivity is field dependent and humidity insensitive.

It is another object of this invention to provide coated pigments that will form toners that do not blur upon handling of unfused toner images.

It is still an additional object of this invention to form fatty acid coated pigments by a simple process.

There and other objects of the invention are accomplished by neutralizing a fatty acid with ammonium hydroxide to form a water soluble ammonium compound in aqueous solution, adding particles to the solution to form a slurry or dispersion and heating the solution below the boiling point followed by filtering the solution and drying the coated particles recovered from the dispersion.

In a specific embodiment in accordance with the instant invention a purified stearic acid is neutralized with ammonium hydroxide to form a water soluble ammonium compound. Magnetite pigment is added to the aqueous solution with agitation such that the ammonium compound is deposited on the pigment surface and then decomposed and converted back to the stearic acid by heating. The coated material is filtered washed and dryed.

BRIEF DESCRIPTION OF THE DRAWINGS

FIG. 1 illustrates the resistivity versus electrical field strength of a toner produced using the coated pigments formed in accordance with the instant invention.

DESCRIPTION OF THE INVENTION

The toner formed from the coated pigments of the instant invention generally have resistivity that is dependent on the strength of the electrical field. The great field dependent resistivity change of these toners allows transfer porcesses without use of specially treated paper or transfer techniques such as pressure or use of adhesives. Further the toner is conductive at high fields so as to easily develop by inductive techniques.

The toners with the coated pigment of the instant invention have a resistivity of greater than about $10^{12}$ ohm-cm at low fields of about 10 volt/cm which corresponds to about 1 log E volt/cm as used in the drawing. It is preferred that the high resistivity of greater than about $10^{12}$ ohm-cm be maintained at at least up to about 100 volt/cm field strength which corresponds to about 2 log E volt/cm in the drawings to give greater transfer latitude. The preferred initial resistivity is greater than $10^{14}$ ohm-cm which of course corresponds to about 14 log E ohm-cm on the drawing as the range allows good development of the electrostatic image. The toners with the coated particles, of the invention, display a substantially stable resistivity as field strength increases and then have a sharp break point where the resistivity rapidly decreases at a slope of greater than about 5 when plotted as the log of powder resistivity (ohm-cm) versus log of the field in volt/cm. The preferred slope is greater than about 10. Generally the slope is about 10 to 20 for toners with the coated pigments of the invention. The slope greater than about 10 is preferred as it results in excellent electrostatic transfer and also good development.

The magnetic pigments of the instant invention are referred to as magnetic because they are attracted to a magnet. They are not themselves magnets. The toners are held to a magnetic brush roller or belt by magnetic forces. The mag brush is biased to induce a charge, opposite to that carrier by the photoreceptor, into the toner particles. Then the outer particles develop the electrostatic image as the electrostatic forces overcome the magnetic forces to deposit toner in the image areas. The earlier referenced U.S. Pat. No. 3,909,258 has illustrations of the forces present in the developing process utilizing a magnetic brush system without a carrier.

The drawing illustrates the resistivity versus electrical field strength of a toner produced using the coated pigments formed in accordance with the instant invention. As illustrated the toner has a high resistivity of about $10^{16}$ ohm-cm that remains substantially the same as the electrical field strength is increased to about 3 log E volt/cm at which a sharp break occurs and the resistivity drops sharply at a slope greater than 5.

The magnetic pigment used to form the coated pigment of the invention may be any suitable particle which will give the desired magnetic and electrical properties in a toner subsequently formed. Typical of such materials are ferrites, iron particles and nickel alloys. Preferred for the instant process are magnetite particles as they are black in color, low cost and provide excellent magnetic properties. The magnetite particles may be of any shape and any size which results in a semiconductive particle with good transfer properties. Generally the particle size is between 0.02 micron and about 1 micron. A preferred average particle size for the magnetite particles is about 0.1 to about 0.6 micron average particle size. The particles may be a acicular or cubic shaped.

The material coating the magnetic particle may be any fatty acid or fatty acid derivative material which is compatible with the toner resin and maintains a firm bond to the magnetic particle during mixing with a solvent for the toner resin and spray drying. The magnetic particle coating suitably has one moiety displaying affinity to the magnetic particle surface such as carboxylic, sulfate, sulfonate, phosphate, ester, ether, alcohol, amine, amide groups, and quaternary ammonium compounds or combinations thereof and another moiety which aids dispersion such as hydrocarbon chains of 6 to 22 carbon atoms. Preferred are stearic acid, palmitic acid, myristic acid, lauric acid, pentadeconic acid, margaric acid, oleic acid, linoleic acid and mixtures and derivatives thereof, which have been found to have good dispersion properties and result in desirable semiconductive properties that aid in transfer. The amount of the coating may vary between about 0.1 and 10 percent by weight. A suitable range of coating material for magnetite is about 1 to about 5 weight percent of the magnetite. A preferred range is about 2 to about 3 weight percent for good insulative properties at low field.

While not wishing to be bound by any theory as to why the instant toners display their remarkable field dependent properties it is believed that the properties are somehow related to the concentration of magnetic particles at the surface of the toner and that the coating of the magnetic pigment contributes to this higher concentration that results after spray drying. It is thought that the stability under humidity variance is related to the hydrophobic properties of the fatty acid coating or to covering of hydrophilic groups on the pigment particles.

The toner resins for use with the coated pigment of the invention may be selected from any suitable toner resin material that is compatible with the coating of the magnetite.

While any suitable transparent resin possessing the properties as above described may be employed in the system of the present invention, typical of such resins are polyamides, epoxies, polyurethanes, vinyl resins and polymeric esterification products of a dicarboxylic acid and a diol comprising a diphenol. Any suitable vinyl resin may be employed in the toners of the present invention including homopolymers or copolymers of two or more vinyl monomers. Typical of such vinyl monomeric units include: styrene, p-chlorostyrene; vinyl naphthalene, ethylencally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization technique such as free radical, anionic and cationic polymerization processes. Any of these vinyl resins may be blended with one or more other resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the instant invention. The diphenol reactant has the general formula:

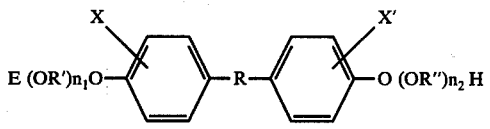

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' represent substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms and R' and R'' represents an alkylene radical having from 3 to 4 carbon atoms are preferred because greater blocking resistance, increased definition of xerographic characters and more complete transfer of toner images are achieved. Optimum results are obtained with diols in which R' and R'' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Preferred results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis(4-beta hydroxy ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxypropoxy-phenyl)-propane, 2,2-bis(4-hyroxy-propoxy-phenyl) propane, 1,1-bis(4-hydroxy-ethoxy-phenyl)-butane, 1,1-bis(4-hydroxy isopropoxy-phenyl) heptane, 2,2-bis(3-methyl-4-betahydroxy ethoxy-phenyl) propane, 1,1-bis(4-beta hydroxy ethoxy phenyl)-cyclohexane, 2,2'-bis(4-beta hydroxy ethoxy phenyl)-norbornane, 2,2'-bis(4-beta hydroxy ethoxy phenyl)norbornane, 2,2-bis(4-beta hydroxy styryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylate and the average number of oxypropylene groups per mole is 2.5, and the like. Diphenols wherein R represents an alkylidene radical having from 2 to 4 carbon atoms and R' and R'' represent an alkylene radical having from 3 to 4 carbon atoms are preferred because greater blocking resistance, increased definition of xerographic characters and more complete transfer of toner images are achieved. Optimum results are obtained with diols in which R is isopropylidene and R' and R'' are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner compositions of this invention either substituted or unsubstituted, saturated or unsaturated, having the general formula:

$$HOOC\ R'''_{n_3}\ COOH$$

wherein R''' represents a substituted or unsubstituted alkylene radical having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist and formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: resin modified phenol-formaldehyde resin, oil modified epoxy resins, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable the colorant may be added prior to, simultaneously with or subsequent to the blending or polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Reissue 25,136 to Carlson and polystyrene blends as described in U.S. Pat. No. 2,788,288 to Rheinfrank and Jones.

Any method of toner particle formation may be utilized with the coated particles of the instant invention which results in toner of the desired properties. The preferred method with the pigments of the instant invention is forming a solvent dispersion of the magnetite and toner resin and spray drying the dispersion as this results in toner particles having the magnetite concentrated on the surface and results in toner of good magnetic and electrical properties for excellent development and trasnfer to plain paper.

The solvent used for spray drying may be any material capable of dissolving the toner resin without adversely effecting the coating of the magnetite. Solvents for toner resins are well known including hydrocarbons, alcohols, ketones, esters, amides, fluorinated hydrocarbons, chlorinated hydrocarbons and other well known solvents. Preferred solvents are toluene for use with styrene polymer blends as this results in a toner that is solvent free and the solvent is low cost and relatively non-toxic. Chloroform has been found to be a preferred solvent for use with polyester type toner resins as it is readily available nonflammable and results in a toner of low residual solvent. Both chloroform and toluene also are compatible with the preferred stearic acid and has a derivative coating for the magnetite. The solvent is generally used in an amount such that the solids content of the solvent slurry is 5–20% by weight. The term solids content is used here to indicate the solid resulting from spray drying which is the resin and magnetite plus any other additives to the toner such as colorants or triboelectric regulators.

Magnetite coated by the instant inventive process is of very low humidity sensitivity which is an advantage in toner formation and further readily is dispersed in solvents and resins without effecting the properties of the coating. This process of the invention is generally performed by neutralizing a fatty acid, such as stearic acid or a derivative of a fatty acid with ammonium hydroxide to form a water soluble ammonium compound. The pigment preferably magnetite, is then added to the aqueous solution with agitation. Ammonium compound is adsorbed on the pigment surface and then decomposed and converted back to the fatty acid or derivative of a fatty acid by heating. The aqueous dispersion is then filtered, washed and dryed. The pigment coated by this process is hydrophobic and has good dispersion properties in organic matrixes such as polymer resins and organic solvents. Among suitable fatty acids and fatty acid derivatives are stearic, myristic, lauric, pentadecanoic, palmitic, lauric margaric, oleic and linoleic acids and mixtures thereof. Among suitable fatty acid derivitives are halogen, hydroxyl, and amino substituted fatty acids or carboxylates. Preferred are stearic acids and mixtures of stearic acid and other fatty acids of $C_6$ to $C_{22}$ to give good coating and electrical properties.

While the above discussion has not included the addition of additives to the solvent prior to spray drying for inclusion in the toner it is encompasssed that additives such as dyes, pigments, dispersing agents, humidity sensitivity control materials may be added prior to toner formation. The preferred magnetite materials coated by the instant process are black and therefore suitable for the majority of electrophotographic reproduction uses without benefit of colorant additives. However, other less dark colored magnetic materials might require pigment or dye additives to obtain a suitable toner color. Such pigments and dyes are not needed to obtain the field dependency required of toners using the magnetite coated by the process of the invention.

While the above discussion has dealt primarily with magnetite pigments and their use in toners, the coating process and coated particles of the instant invention are also suitable for use in liquid inks and paints where low humidity sensitivity is an advantage. The coating process further maybe used to coat pigments so that they do not react with mediums that they color such as molding resins or powder coatings. Further at high loadings of over about 80% the coated particles of the invention may be incorporated in suitable mediums for the formation of permanent magnets.

It is further contemplated that after treatment processes such as classification might be necessary depending on the particle size range achieved by the spray drying.

DESCRIPTION OF THE PREFERRED EMBODIMENTS

The following Examples further define, describe and compare methods of preparing developers of the instant invention and of utilizing them in electrophotographic applications. Parts and percentages are by weight unless otherwise indicated.

EXAMPLE I 96 grams of polystyrene resin are dissolved in 500 grams toluene. After dissolving the resin in the toluene, 104 grams of coated Pfizer-MO-4232 magnetite is added to a Kady mill containing the solution and is milled for 30 minutes. The coated magnetite is prepared by placing six grams of purified stearic acid in a one-liter resin reaction kettle containing 400 ml of deionized water. The purified stearic acid actually contains stearic acid about 88%, palmitic acid about 6%, myristic acid about 4.5% and lauric acid 1.5%. The mixture is heated to about 70° C to melt the stearic acid. 20 ml of concentrated $NH_4OH$ (28–30%) is slowly added to the stearic acid and water with stirring. In the process, the $NH_4OH$ reacted with the stearic acid to form water-soluble ammonium stearate. 200g of Pfizer (uncoated) magnetite MO-4232 is added to the ammonium stearate solution with vigorous stirring. The mixture is then heated to 90°–95° C and maintained at that temperature until no more gas bubbles are evolved. The mixture is cooled down and filtered with a Buchner funnel and filter paper. The filtered cake was washed with deionized water and placed on a glass tray and in an oven at about 110° C for 20 hours. After drying, the clumps were broken up with a spatula and screened with a 100 mesh sieve. After milling the dispersion is fed to a Bowen spray dryer at a feed rate of 200 milliliters per minute and a temperature of 180°–220° F. Toner particles having an average size of about 15 microns and a range of from about 5 to about 30 microns are recovered. The toner displays good flow characteristics and semiconductive electrical properties. Its powder resistivity is field dependent. It has an initial resistivity of about $10^{16}$ ohm-cm. The powder resistivity is insensitive to relative humidity. These toners are found to be capable of rapid development by using a magnetic system without carrier and are successfully transferred by electrostatic transfer at about a 75 percent rate of transfer efficiency.

EXAMPLE II

The process of Example I is repeated except 4 grams of the stearic acid were used. The toner displays excellent transfer properties similar to Example I.

EXAMPLE III

The process of Example I is repeated except 96 grams of 65/35 styrene butylmethacrylate resin is substituted for the polystyrene resin, about 104 grams of Pfizer Mo-4232 an acicular shaped magnetite is the magnetite and about 2½ gms of purified stearic acid are utilized. The toner demonstrates good development and transfer properties. The toner also exhibits virtually identical powder resistivity at low (22%) relative humidity and high (85) relative humidity. The resistivity at low fields is about $10^{15}$ ohm-cm.

EXAMPLE IV

The process of Example I is repeated substituting about 96 grams of 65/30 styrene-n-butylmethacrylate (resin) as the resin, substituting about 104 grams of Cities Service Mapico Black magnetite, a cubic magnetite as the magnetite and 5 grams of purified stearic acid. The resistivity of the toner is virtually uneffected by humidity. The print quality and transfer efficiency is excellent. The initial resistivity at low field is about $10^{15}$ at high field.

EXAMPLE V

The process of Example I is repeated substituting about 70 grams of 65/35 styrene-butylmethacrylate resin as the resin, about 130 grams of Cities Service Mapico Black as the magnetite and about 3 grams of the purified stearic acid. The toner has excellent transfer and development characteristics. It has an initial resistivity of about $10^{16}$ ohm-cm.

The resistivity measurements for toner used throughout this application are determined by the following process. Measurements on powder are complicated by the fact that the results are influenced by characteristics of the powder particles, shape and size in addition to powder composition. Therefore, measurements were obtained on powder rather than by molding the powder into a pellet specimen in order to better relate the properties to the toner behavior in development. The measurements were made using a two inch diameter electrode of a Balsbaugh cell for measuring the direct current resistivity of the toner. The gap distance is 0.05 inch. The toner is packed between the electrodes of the cell by vibration until a constant bed volumn is reached. The current is measured as a function of applied voltage at the 50 mil gap. The electrification time is 1 minute as recommended by ASTM method. After each measurement the sample is repacked by vibration. Resistivity is calculated according to Ohms law and the date as presented in the figures is as a Log of resistivity verses Log of field strength.

Although specific materials and conditions were set forth in the above exemplary processes in the formation and using the toner of the invention these are merely intended as illustrations of the present invention. Various other substituents and processes such as those listed above may be substituted for those in the examples with similar results. In addition to the steps used by the coating of the present invention other steps or modifications may be used. For instance the pigment could be classified separated by other filtering methods. In addition other materials such as colorants could be added.

The transfer efficiency of the toners with the coated pigment of the instant invention is greater than about 70 percent and generally reaches 85 percent in ordinary electrostatic transfer.

The coated magnetic pigment of the invention may be utilized in any amount that forms a magnetic field dependent toner. A suitable range has been found to be a magnetic pigment content between about 40 and about 70 weight percent of coated magnetic particle in the finished toner. A preferred range is a coated magnetite content between about 45 and 55 weight percent of coated magnetite for good magnetic development properties and good transfer.

Other modifications of the present invention will occur to those skilled in the art upon reading the present disclosure. These are intended to be included within the scope of this invention. For instance, the coated magnetic particles of this invention could be utilized in formation of permanent magnets or in a paint as a magnetic coating. Further the coating method could be used to treat colored pigments for toner use to reduce humidity sensitivity.

What is claimed is:

1. A process of coating magnetic toner particles comprising neutralizing a fatty acid material selected from the group comprising fatty acids, fatty acid derivatives and mixtures thereof with ammonium hydroxide to form a water soluble ammonium compound in aqueous solution, adding particles to the solution, heating the solution at below the boiling pont, filtering the solution, washing and drying to recover the coated particles wherein said fatty acid material is present in an amount between about 0.1 and 10 weight percent of the particle.

2. The process of claim 1 wherein said particles comprise sub micron magnetic toner particles.

3. The process of claim 2 wherein said particles comprise magnetite.

4. The process of claim 1 wherein said fatty acid is selected from the group consisting of stearic acid, palmitic acid, myristic acid, lauric acid, pentadecanic acid, margaric acid, oleic acid, linoleic acid and mixtures and derivatives thereof.

5. The method of claim 1 wherein said fatty acid material comprises between 6 and 22 carbon atoms.

6. The method of claim 1 wherein said fatty acid material is present in an amount between about 2 and about 3 weight percent of the particle.

7. A method of toner formation comprising neutralizing a fatty acid material selected from the group comprising fatty acids, fatty acid derivatives and mixtures thereof with ammonium hydroxide to form a water soluble ammonium compound in aqueous solution, adding magnetic toner particles to the solution, heating the solution at below the boiling point, filtering the solution, washing, drying to recover the coated particles, mixing said coated particles into a solution of solvent and resin to form a slurry and spray drying said slurry to form a toner wherein said fatty acid material is present in an amount between about 0.1 and 10 weight percent of the particle.

8. The process of claim 7 wherein said particles comprise sub micron magnetic toner particles.

9. The process of claim 8 wherein said particles comprise magnetite.

10. The process of claim 7 wherein said fatty acid is selected from the group consisting of stearic acid, palmitic acid, myristic acid, lauric acid, pentadecanic acid, margaric acid, oleic acid, linoleic acid, and mixtures and derivatives thereof.

11. The method of claim 7 wherein said fatty acid material comprises between 6 and 22 carbon atoms.

12. The method of claim 7 wherein said fatty acid material is present in an amount between about 2 and about 3 weight percent of the particle.

13. A method of toner formation comprising neutalizing a fatty acid material selected from the group comprising fatty acids, fatty acid derivatives and mixtures thereof with ammonium hydroxide to form a water soluble ammonium compound in aqueous solution, adding magnetic particles to the solution, heating the solution at below the boiling point, filtering the solution, drying to recover the coated particles, mixing said coated magnetic particles into a solution of solvent and resin and a solvent to form a slurry and spray drying said slurry to form a toner comprising resin and coated magnetite wherein the coating comprises a fatty acid or fatty acid derivative and the toner is characterized by a field dependence such that at low fields of less than 10 volt/cm the resistivity is greater than $10^{12}$ ohm-cm and at some higher field they exhibit a sharp drop to a resistivity of less than $10^{8}$ ohm-cm along a line of a slope greater than 5 when log of powder resistivity is plotted versus the log of the field in volt/cm.

14. The method of claim 13 wherein the resistivity is greater than $10^{12}$ ohm-cm at fields of greater than 100 volt/cm.

15. The method of claim 13 wherein said slope is greater than 10.

16. The method of claim 13 wherein said slope is between about 10 and about 20.

17. The method of claim 13 wherein the resistivity at low field is greater than $10^{14}$ ohm-cm.

18. The method of claim 13 wherein said fatty acid is selected from the group consisting of stearic acid, palmitic acid, lauric acid, myristic acid, pentadecanic acid, margaric acid, oleic acid, linoleic acid, and mixtures and derivatives thereof.

* * * * *